US006094841A

United States Patent [19]

Adams

[11] Patent Number: 6,094,841

[45] Date of Patent: Aug. 1, 2000

[54] TONGUE FOR FOOTWEAR

[75] Inventor: Thomas M. Adams, San Antonio, Tex.

[73] Assignee: In-Stride, Inc., San Antonio, Tex.

[21] Appl. No.: 09/167,023

[22] Filed: Oct. 6, 1998

Related U.S. Application Data

[60] Provisional application No. 60/104,598, Oct. 6, 1997.

[51] Int. Cl.[7] ..... A43B 23/26

[52] U.S. Cl. ..... 36/99; 36/54; 36/72 R

[58] Field of Search ..... 36/99, 138, 54, 36/72 R

[56] References Cited

U.S. PATENT DOCUMENTS

| | | |
|---|---|---|
| 601,192 | 3/1898 | Woodside . |
| 1,265,281 | 5/1918 | Tweedie . |
| 1,309,958 | 7/1919 | Phillips . |
| 1,809,998 | 6/1931 | Wernmark . |
| 2,139,858 | 12/1938 | Schwartz et al. . |
| 2,244,030 | 6/1941 | Teehan . |
| 2,244,031 | 6/1941 | Teehan . |
| 3,546,796 | 12/1970 | Adams . |
| 4,372,060 | 2/1983 | Adamik . |
| 4,373,275 | 2/1983 | Lydiard ..... 36/129 |
| 4,377,913 | 3/1983 | Stone . |
| 4,442,613 | 4/1984 | Dobbin . |
| 4,534,122 | 8/1985 | MacPhail . |
| 4,584,783 | 4/1986 | Dobbin . |
| 4,622,763 | 11/1986 | Adams . |
| 4,805,321 | 2/1989 | Tonkel . |
| 4,899,466 | 2/1990 | Skaja . |
| 5,265,353 | 11/1993 | Marega et al. . |
| 5,337,493 | 8/1994 | Hill . |
| 5,581,912 | 12/1996 | Adams . |

FOREIGN PATENT DOCUMENTS

| | | |
|---|---|---|
| 2 390 120 | 5/1978 | France . |
| 2 526 277 | 4/1983 | France . |

OTHER PUBLICATIONS

International Search Report date Jan. 26, 1999 for PCT/US98/20959.

*Primary Examiner*—Ted Kavanaugh

*Attorney, Agent, or Firm*—Akin, Gump, Strauss, Hauer & Feld, L.L.P.

[57] ABSTRACT

Footwear with single or double vamp sections comprising a split tongue including a rearward tongue portion which is firmly attached along one side thereof to a medial vamp section of the shoe. While the rearward tongue portion is firmly connected to a medial vamp section, the connection may be permanent or replaceable. A forward tongue portion may be integrally formed with the forward upper, or be an extension of the forward upper, or be secured to the forward upper along a transverse edge and/or to one or both of the vamp sections, or be secured to one of the vamp sections only. One or both tongue portions may be formed to have pockets for receiving cushioning members and/or saddle members to reduce pressure on the instep. The forward edge of the rearward tongue portion overlies the rearward edge of the forward tongue portion in the working position. The split tongue arrangement, particularly with the rearward tongue portion being attached to the medial vamp section, eliminates slippage of the tongue to the lateral side of the foot during use of the footwear while protection and comfort is provided by the cushioning members and/or saddle members.

10 Claims, 7 Drawing Sheets

TONGUE FOR FOOTWEAR

This application claims priority to Provisional Application No. 60/104,598, filed Oct. 6, 1997.

FIELD OF THE INVENTION

The present invention pertains to footwear which incorporates a tongue. The footwear includes a split tongue having a lower portion secured to a medial vamp section and/or the forward upper and an upper portion secured to a medial vamp section to eliminate slippage of the tongue to the lateral side of the wearer's foot. The upper portion of the split tongue may be replaceably attached to a medial vamp section.

BACKGROUND OF THE INVENTION

Laced footwear, as well as footwear having other means for fastening the vamps over a longitudinal tongue extending over the instep, suffer from the long-standing problem of the tongue tending to slip off to the lateral side of the foot, at least partly as a result of the shape of the instep. This problem is particularly aggravated in athletic shoes, such as tennis shoes, baseball shoes, basketball shoes and other sport shoes wherein extreme pressure is repeatedly placed on the feet in lateral directions.

When the shoe tongue slips off to the lateral side of the foot, the laces, buckles, eyelet grommets or other fastening members directly engage the instep, tending to cause discomfort and possible injury. Moreover, when the tongue slips to the lateral side, the shoe tends to become loose on the wearer's foot. Sport and specialized athletic footwear particularly tend to suffer from slippage of the tongue. In many instances dress shoes also tend to suffer from the above described slippage, particularly after moderate to long periods of wear, which not only causes discomfort to the wearer, but also detracts from the aesthetic appeal of the footwear.

One effort which has been made to avoid the above-mentioned slippage is to attach the tongue to the toe cap or forward upper of the shoe with heavier or increased numbers of rows of stitching in an effort to avoid the tendency for the tongue to bend laterally into the slipped position described herein. However, this solution has been somewhat unsatisfactory in that the increased stitching can be unattractive and can cause discomfort to the wearer of the shoe. Increasing the stiffness of the tongue is also an unappealing option due to lack of compliance of the tongue with movement of the foot, particularly in sport type shoes.

Another effort which has been made to avoid tongue slippage is to provide footwear wherein a single, unitary tongue is attached to the medial vamp section by an elastic or stretchable member which normally holds the tongue in its preferred working position. However, the elasticity or stretchability of the attachment member may allow the tongue to slip to the lateral side of the foot during use thereby failing to solve the tongue slippage problem.

Still further, prior footwear has been developed wherein a single, unitary tongue may be secured (during usage of the footwear) along one side of the tongue to the medial vamp section by hook and loop fastener strips. The forward end of the tongue remains secured to the forward upper and the rearward end of the tongue is usually detached during unfastening and removal of the shoe. This type of nonreplaceable attachment of the unitary tongue to the footwear is also unsatisfactory in that hook and loop fastener strips tend to snag on the wearer's stocking or sock when donning or removing the shoe and during use. Moreover, with this type of attachment it is inevitable that the tongue will become detached sooner or later during usage of the footwear due to accumulation of lint or other material in the hoop or loop portions. Accordingly, these prior art single vamp tongue attachments have been unsatisfactory in one respect or another.

The present invention overcomes the problems mentioned hereinabove with an improved tongue construction for single vamp as well as double vamp laceable shoes and shoes using other types of fastening means between opposed vamps or upper portions of the shoe.

SUMMARY OF THE INVENTION

The present invention provides an improved shoe construction, including a tongue which is attached to the shoe in such a way as to eliminate slippage to either the lateral or medial side of the shoe. The tongue of the present invention is a split tongue, the upper or rearward portion of which is firmly connected, either permanently or replaceably, to a vamp.

In accordance with one aspect of the present invention, improved footwear is provided which includes a shoe having upper portions characterized by single opposed vamp sections, as well as a double vamp construction, wherein a split tongue is provided which is attached to the shoe in such a way as to eliminate slippage of the tongue during wearing of the shoe. In a shoe having a single vamp construction, the split tongue may be configured such that a forward portion of the tongue is secured to the forward upper across a front edge of the forward tongue portion. In such configuration, the forward tongue portion may also be secured to the medial vamp section. The forward tongue portion may also be formed integral with the forward upper, or be an extension of the forward upper and secured to the medial vamp section. That is, the forward tongue portion may be formed as an extension of the toe cap or as a separate piece which is attached to the toe cap by stitching or some other means. The rearward or upper portion of the split tongue is firmly connected, either permanently or replaceably, to the vamp, preferably the medial vamp section, along one longitudinal side of the tongue portion. The tendency for the tongue to slide off to the lateral side of the instep of the wearer's foot is thus completely eliminated, the shoe retains its intended appearance, the shoe does not become loose during wearing thereof, and there is no degradation of comfort to the person wearing the shoe.

In accordance with another aspect of the invention, a double-lace or double vamp shoe construction is provided having upper and lower vamps, wherein a tongue construction is provided which also includes a lower or forward tongue portion disposed under the lower or forward vamp sections and connected to or formed as an extension of the toe cap or forward upper. The forward tongue portion may also be permanently connected along a side of the tongue portion to the medial forward vamp section. The upper or rearward tongue portion is firmly connected, either permanently or replaceably, to one of the upper or rearward vamp sections, preferably the medial upper vamp section. This tongue arrangement also minimizes or eliminates the tendency for the tongue portions to slip laterally during wearing of the footwear. In a preferred arrangement for either the single or the double vamp construction, the upper tongue portion at least partially overlies the lower tongue portion. Alternatively, the lower edge of the upper tongue portion may meet the upper edge of the lower tongue portion.

As used herein, "a forward tongue portion connected to said footwear" means that the forward tongue portion is an extension of the forward upper (but not forming an integral tongue portion in the forward upper or toe cap), or is permanently attached to the forward upper and/or a vamp. Also as used herein, the rearward tongue portion "firmly connected" to a vamp means that the rearward tongue portion is permanently attached such as with stitches (or other means as provided herein or as known to one of skill in the art in light of the present disclosure) or that the rearward tongue portion is replaceably attached such as with hook and loop fastener means (or other means as provided herein or as known to one of skill in the art in light of the present disclosure). The rearward tongue portion, when secured or attached either permanently or replaceably to a vamp, is firmly connected.

In accordance with yet another aspect of the invention, a shoe construction is provided wherein one or both portions of a split tongue include a pocket for removably receiving a layer or pad of cushioning material or a member characterized by a piece of material such as a thin graphite-plastic composite which, when depressed by tying the footwear laces or securing other fastening devices, tends to protect the underlying portion of the foot by resisting and distributing pressure caused by the laces or other footwear fastening devices. Alternatively, a footwear saddle may be used in accordance with the invention disclosed and claimed in my U.S. Pat. No. 5,581,912 issued Dec. 10, 1996 entitled FOOTWEAR SADDLE which is hereby incorporated herein by reference.

The permanent and firm connection of the upper or rearward tongue portion to a vamp provides an upper or rearward tongue portion which is nonremoveable or nondetachable during normal usage of the shoe, and which maintains its position relative to the vamp section to which it is connected. The replaceable and firm connection of the upper or rearward tongue portion to a vamp provides an upper or rearward tongue portion which may be removed and replaced by a different tongue portion; yet during connection, the replaceable tongue is in firm connection. The present invention further provides a tongue construction for footwear which is more comfortable to the wearer of the footwear than prior tongue constructions, is easy to assemble during manufacture of the shoe and includes advantages which will be appreciated by those skilled in the art.

DESCRIPTION OF THE PREFERRED EMBODIMENTS

Figure 1:
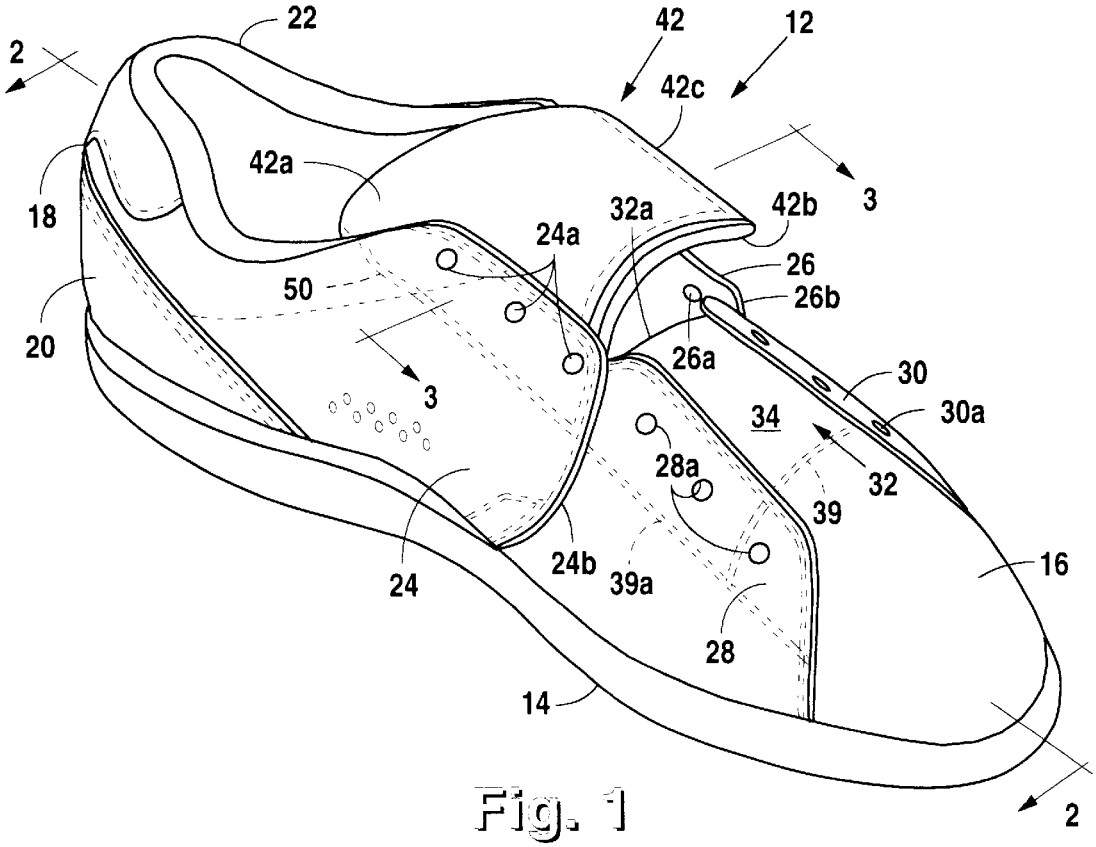
FIG. 1 is a perspective view of a double-lace or double-vamp shoe illustrating a split tongue construction in accordance with the present invention.
Figure 5:
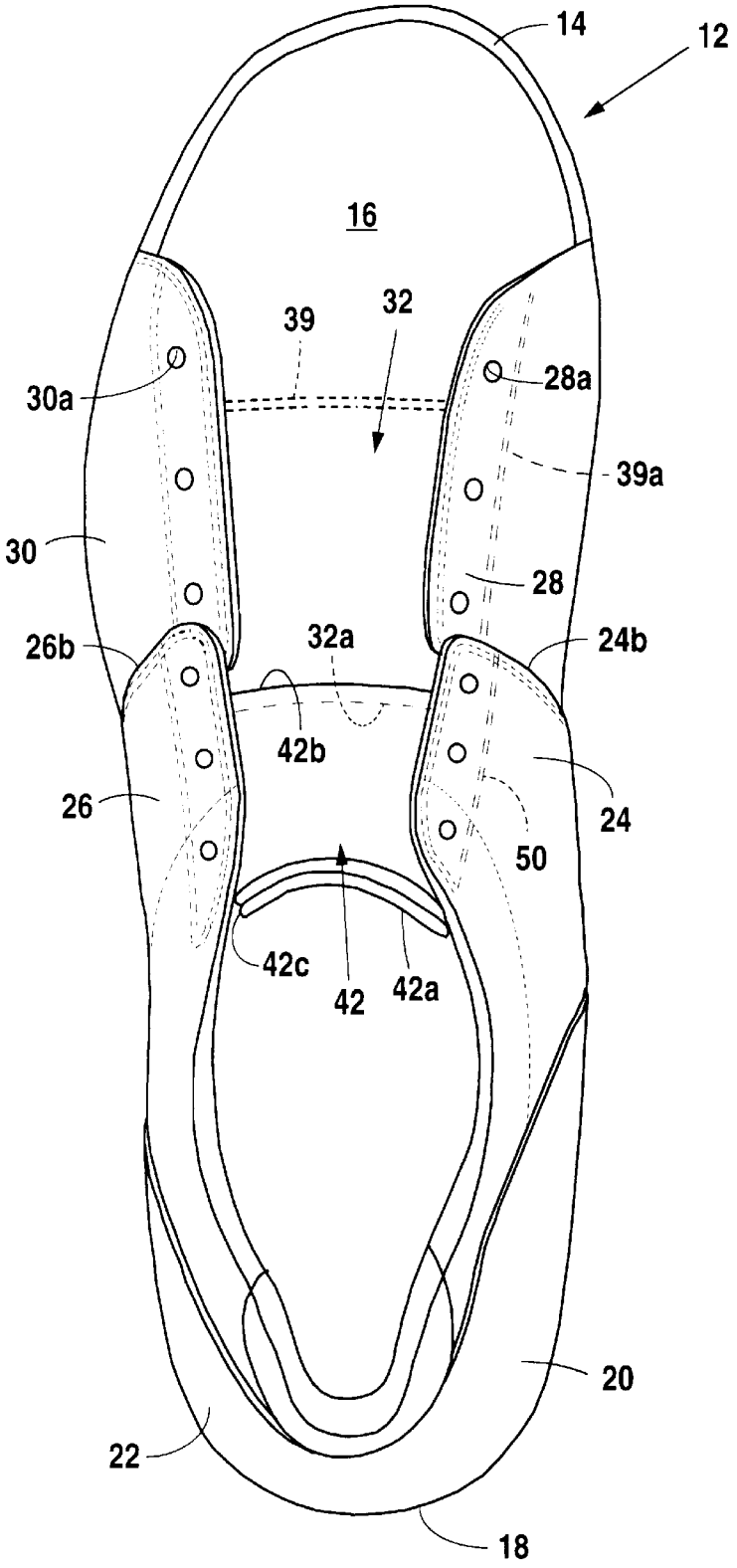
FIG. 5 is a top plan view of the double-lace shoe shown in FIGS. 1 through 3.
Figure 6:
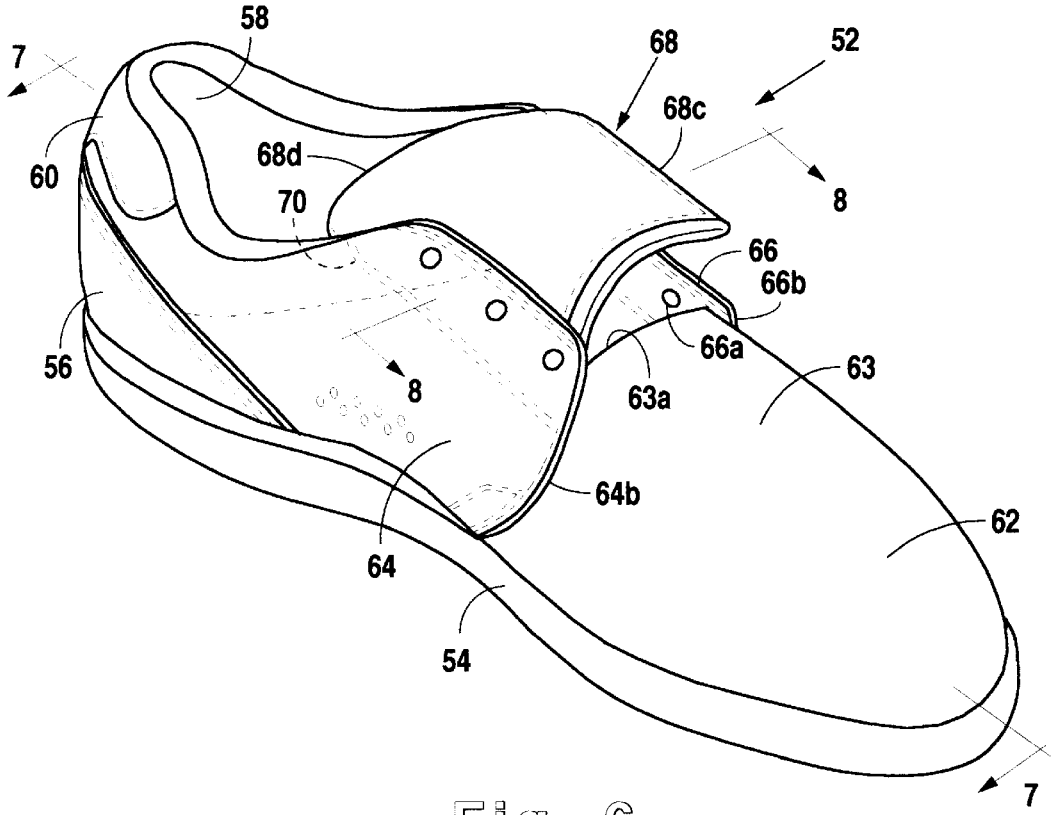
FIG. 6 is a perspective view of a single-lace shoe having a tongue construction in accordance with the invention.

Referring to FIGS. 1 and 5, there is illustrated footwear constructed in accordance with the invention characterized as a sport shoe, such as a tennis or running shoe, for example, and generally designated by numeral 12. The shoe 12 is similar in some respects to the special sport shoe described in my U.S. Pat. No. 3,546,796 issued Dec. 15, 1970, the disclosure of which is incorporated herein by reference. The shoe 12 includes a conventional sole 14 made of suitable material for sport shoes and having a bottom friction surface, not shown. The shoe 12 includes a forward upper or toe cap 16, also formed of conventional materials for use in sport shoes, and a conventional heel 18 defined by opposed upper portions or quarters 20 and 22. The quarters 20 and 22 are brought together in a conventional manner to form the heel 18 and are also attached to the sole 14 in a conventional manner. Forward opposed side portions of the uppers or quarters 20 and 22 are formed as opposed upper or rearward vamp sections 24 and 26. The left shoe 12 is shown by way of example and the parts of the right shoe, not shown, would be essentially mirror images of the parts shown and described herein. Since the left shoe is shown as shoe 12, the vamp section 24 is the medial rearward vamp section and the vamp section 26 is the lateral rearward vamp section. The vamp sections 24 and 26 have lace receiving eyelets 24*a* and 26*a* spaced therealong in a conventional manner, as shown.

The shoe 12 also includes opposed portions comprising lower or forward vamp sections 28 and 30 which are secured to the sole 14, respectively, in a conventional manner and overlie part of the forward upper or toe cap 16. The vamp sections 28 and 30 extend rearwardly under forward edges 24*b* and 26*b* of the rearward vamp sections 24 and 26, respectively.

Figure 2:
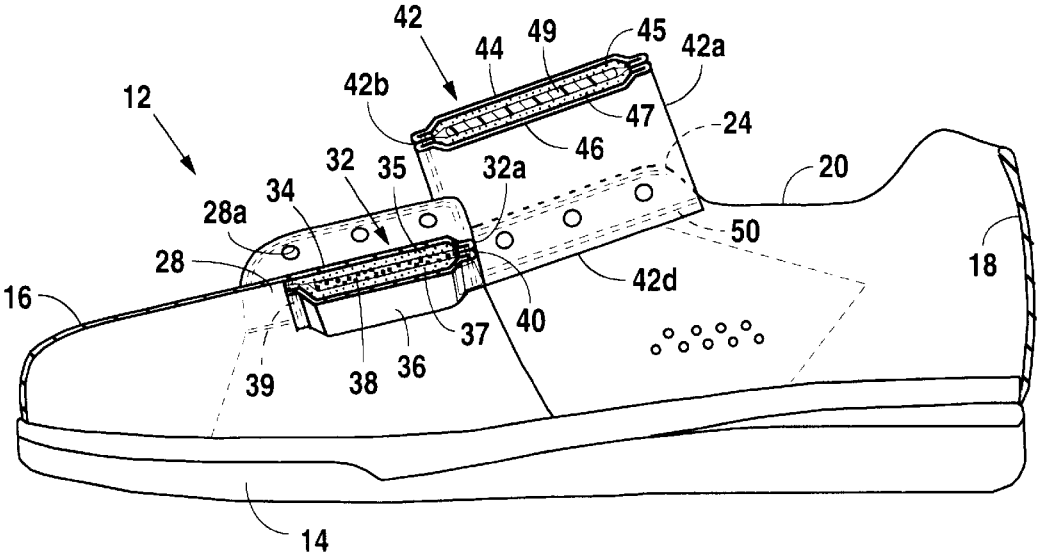
FIG. 2 is a section view taken generally along the line 2—2 of FIG. 1.

Referring to FIGS. 1 and 2, the shoe 12 includes a forward or lower tongue portion, generally designated by numeral 32, which is suitably secured (by stitching or other means) to, as shown, or formed in part by, a rearward extension 34 of the toe cap or forward upper 16. The tongue portion 32 is adapted to be disposed under the opposed forward vamp sections 28 and 30 when these sections are pulled toward each other by conventional laces. As will be noted from viewing FIG. 2, the tongue portion 32 may be fabricated utilizing as one layer of material, the portion 34 of the toe cap or forward upper 16 and having a suitable layer of padding or resilient cushioning material 35 adhered thereto. The tongue part 32 includes a second layer of material 36 having an inner layer of padding or cushioning material 37 adhered thereto and leaving at least a thin, sheet-like space or pocket for receiving an insert 38 which may comprise an elastomer foam pad or a saddle in accordance with that described in my above-referenced U.S. Pat. No. 5,581,912. The insert 38 may also comprise a member characterized by a thin layer of a graphite-plastic composite material which, when deflected or depressed, will tend to protect the underlying portion of the foot and distribute pressure caused by the laces or other fastening devices over a larger area of the foot to thereby reduce any discomfort to the wearer of the footwear 12. Alternatively, the pocket or space formed between the layers of cushioning material 35 and 37 may be left vacant.

Figure 3:
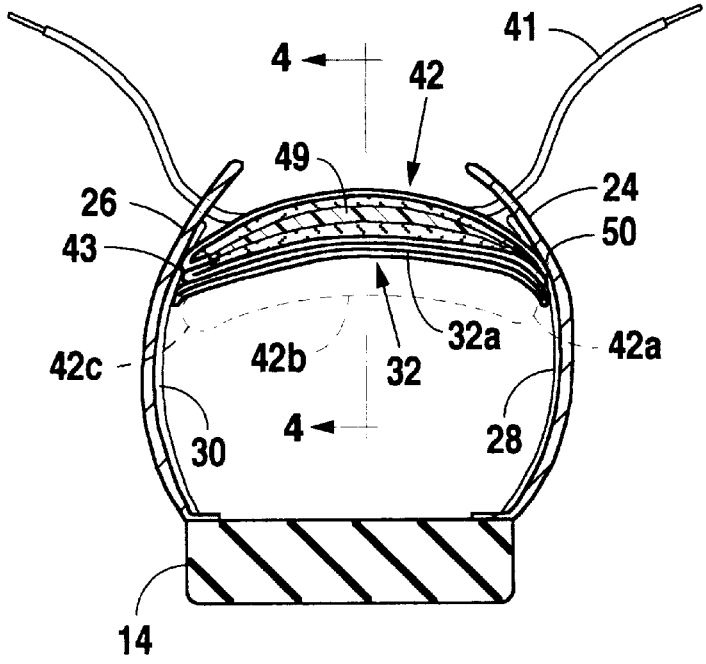
FIG. 3 is a section view taken generally along the line 3—3 of FIG. 1 but showing the upper or rearward tongue portion disposed between the upper or rearward vamp sections.
Figure 4:
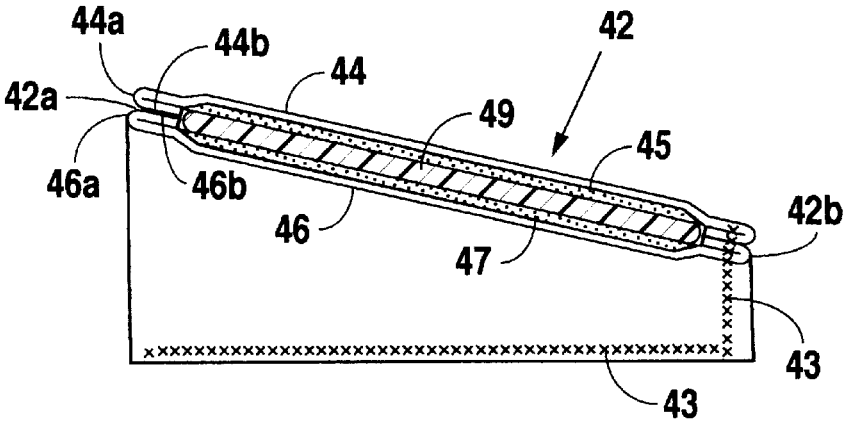
FIG. 4 is a detail section view taken generally along the line 4—4 of FIG. 3.

The rear transverse edge 32*a* of the forward tongue portion 32 may be left open so that the aforementioned foam pad or saddle 38 may be inserted in the tongue portion 32 or removed therefrom at will. The rear transverse edge 32*a* may be provided with suitable releasable fastening means 40, such as strips of hook and loop type fastener, for example, disposed between and secured, respectively, to the layers of material 34 and 36. This arrangement will be explained in further detail with regard to a rearward portion of the split tongue of the present invention described further herein in conjunction with FIGS. 3 and 4. The material layers 34 and 36 are preferably secured to each other across a forward edge, generally parallel to the rear edge 32*a*, and defined by stitching 39.

Referring again to FIG. 1, the forward tongue portion 32 is also preferably secured to at least the medial forward vamp section 28 by stitching 39*a*. The forward tongue portion 32 may also be secured to the lateral forward vamp section 30 by stitching (not shown) generally parallel to the stitching 39*a*. As previously mentioned, the tongue portion 32 may be separately formed and secured to the forward upper 16 by a transverse row of stitching generally coincident with the row of stitching 39. In this regard, the forward upper 16 would be required to extend rearward only sufficiently beyond the row of stitching 39 to permit securing the tongue portion 32 thereto.

Referring further to FIGS. 1 through 4, the footwear or shoe 12 includes a second and separate rearward or upper tongue portion 42 constructed similar to the tongue portion 32 and including an outer layer of material 44 with a layer of padding or cushioning material 45 adhered to the inner surface thereof. The tongue portion 42 includes an inner layer of material 46 similar to the material used for the layer 44 and also having an inner layer of padding or cushioning material 47 adhered thereto. A thin pocket is formed therebetween for receiving a foam pad or saddle of the types mentioned hereinabove and designated by numeral 49. The layers of material 44 and 46 may be secured to each other by a suitable adhesive or by stitching 43, except on rear transverse edge 42*a*. The stitching 43 preferably extends along opposed longitudinal side edges as well as a forward transverse edge 42*b* of tongue portion 42. As further shown in FIG. 4, the material layers 44 and 46 are preferably folded over at their rearward edges 44*a* and 46*a* and suitably secured by stitching or adhesive while the material layers 44 and 46 remain unattached to each other to permit insertion of the foam pad or saddle 49 within the pocket formed between the material layers 44 and 46 and the cushioning layers 45 and 47. Alternatively, releasable fastener means such as hook and loop fastener strips 44*b* and 46*b* (or other means as provided herein or as known to one of skill in the art in light of the present disclosure) may be secured along the rear edges 44*a* and 46*a*, respectively, and releasably secured to each other for closing the pocket and retaining the foam pad or saddle 49 within the pocket formed in the tongue portion 42.

As shown in FIGS. 1, 2, 3 and 5, the forward edge 42*b* of tongue portion 42 preferably overlaps the rearward edge 32*a* of the tongue part 32, and may overlap the vamp sections 28 or 30. The tongue portion 42 is secured along a longitudinal side edge 42*d* to the medial vamp section 24 at a stitching line 50, a suitable distance spaced from the eyelets 24*a*. Stitching line 50 may terminate at a position such that medial forward vamp section 28 may be received between medial rearward vamp section 24 and lower edge 42*b* of rearward tongue portion 42. The opposite side edge 42*c* is unattached. Accordingly, the rearward tongue portion 42 is firmly attached to the medial rearward vamp section 24 and thus resists any deflection or movement toward the lateral side of the foot when the footwear 12 is placed in use. Moreover, the firm attachment of the tongue portion 42 to the vamp section 24 assures that the tongue portion 42 will not become detached or suffer from stretching or other movement. Although the tongue portion 42 is permanently and firmly attached to the vamp section 24 by stitching 50, those skilled in the art will recognize that the tongue portion 42 may be attached to the vamp section by other firm attachment means such as an adhesive, or thermal or chemical bonding of the tongue portion to the vamp section, depending on the materials used for these components, or by means such as rivets for other permanent and firm securements which will completely prevent deflection or movement of the tongue portion 42 toward the lateral side of the foot. Alternatively, tongue portion 42 may be replaceably secured to vamp section 24, such as by hook and loop fastener means attached to vamp section 24 and tongue portion 42. Preferably, the hook or loop fastener means may extend the entire length of edge 42*d* with its mating loop or hook fastener means extending a similar length along vamp section 24. In this configuration, the tongue portion 42 remains secured to vamp section 24, including when the shoe is unfastened, until the wearer replaces tongue portion 42 with an alternate tongue portion 42, such as one having a different color.

Accordingly, the split tongue portions 32 and 42, in the arrangement of the double-vamp or double-laced footwear 12, hold certain advantages. The tongue portion 32 is relatively short and, whether formed as an extension of the toe cap 16 or stitched thereto as a separate part along stitching line 39, has no tendency to be deflected off to either side of the foot. This lack of tendency to deflect laterally is due to the lateral stiffness of tongue portion 32 as a result of its short length, the flatness of the forward part of the typical wearer's instep, and the fact that the tongue portion 32 may be firmly attached to one or the other, or both, of vamp sections 28 or 30. Moreover, by firmly attaching the upper or rearward tongue portion 42 to the medial rearward vamp section 24 in the manner described hereinabove, upper tongue portion 42 cannot slip or move the lateral side of the foot when the footwear is being worn. The tongue portion 42 may also be attached to the shoe along its side edge 42*c* to the lateral rearward vamp section 26 in one of the ways described, instead of the vamp section 24, if desired. However, positioning the point of attachment of the tongue portion 42 on the lateral rearward vamp section 26 may not tend to hold the tongue portion 42 in a preferred or normal working position as well as when it is held by attaching the tongue portion 42 to the inner or medial rearward vamp section 24.

When donning the shoe or footwear 12 together with its mating shoe, the lower or forward vamp sections 28 and 30 are drawn together by laces or other fastening means after placing the shoe on the wearer's foot. The laces are tied and tongue portion 42 is placed over the rearward transverse edge 32*a* of the tongue portion 32, so that the tongue portions 42 and 32 overlap at their edges 32*a* and 42*b*. Alternatively, tongue portion 42 is placed adjacent to the rearward transverse edge 32*a* of the tongue portion 32 so that the tongue portions 42 and 32 meet at their edges 32*a* and 42*b*. The forward edge 42*b* of tongue portion 42 may be placed ever or under the rearward extensions of vamp section 28, and over or under the rearward extensions of vamp section 30. The edges 32*a* and 42*b* may be of varying thickness, such as by tapering the overlapping tongue portions, to minimize the thickness of the overlapped tongue portions for cosmetic and comfort purposes. The rearward or upper vamp sections 24 and 26 are thereafter drawn together by a suitable lacing means, such as lace 41, so that the vamp sections 24 and 26 snugly overlie the tongue portion 42. During use of footwear 12, there is no tendency for the tongue portions 32 or 42 to slip off to the lateral side of the foot or to move out of their normal working position in any direction, due to the configuration of the tongue portions 32 and 42. When removing the footwear 12 from a wearer's foot, the laces pulling the rearward vamp sections 24 and 26 together are untied and loosened first, followed by untying and loosening laces which pull the forward vamp sections 28 and 30 together. This latter step may not be required when removing or donning the shoe if the shoe is sufficiently loosened by untying only the laces associated with vamp sections 24 and 26.

Figure 7:
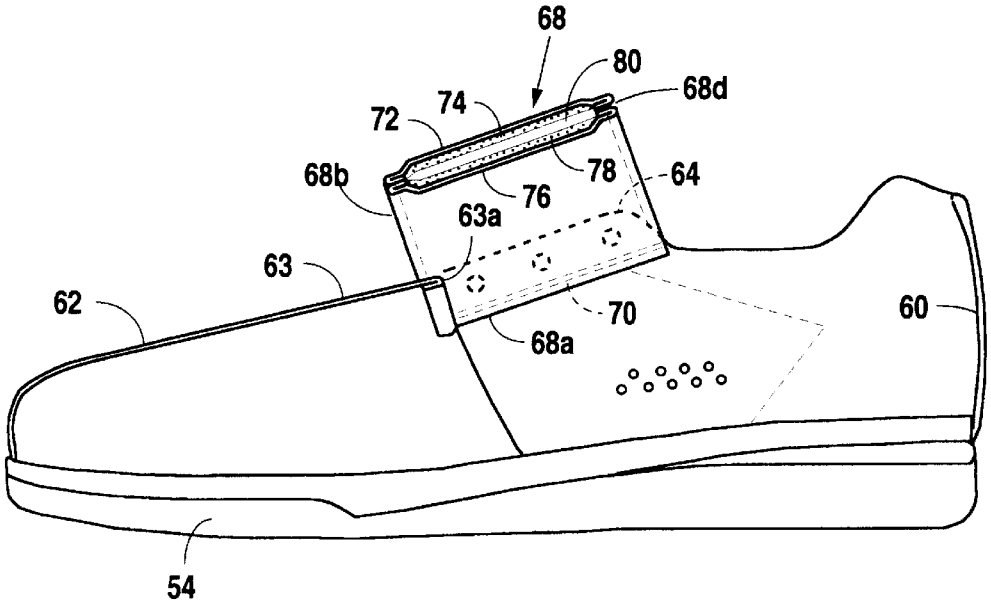
FIG. 7 is a section view taken generally along the line 7—7 of FIG. 6.
Figure 8:
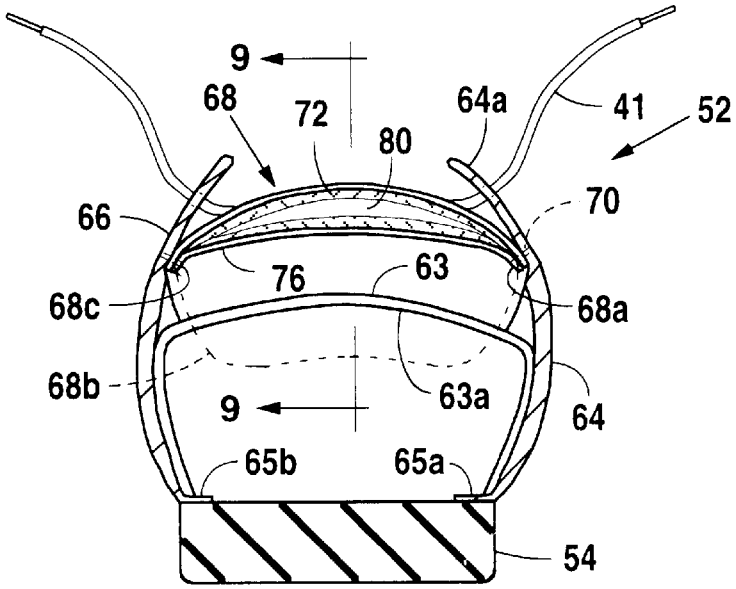
FIG. 8 is a section view taken generally along the line 8—8 of FIG. 6 but showing the upper or rearward tongue portion disposed between the vamp sections.
Figure 9:
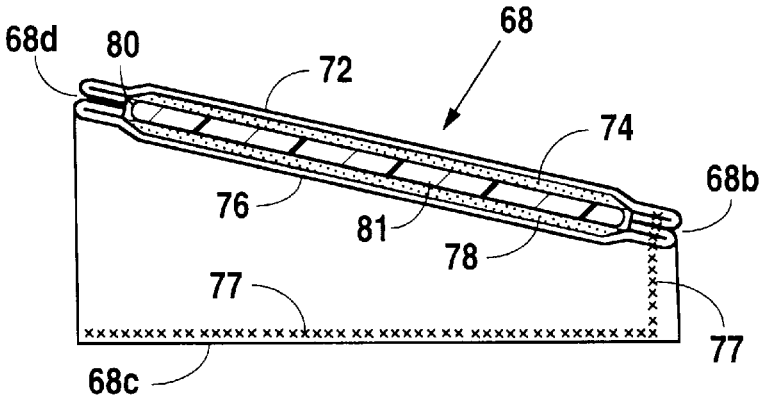
FIG. 9 is a detail section view taken along the line 9—9 of FIG. 8.
Figure 10:
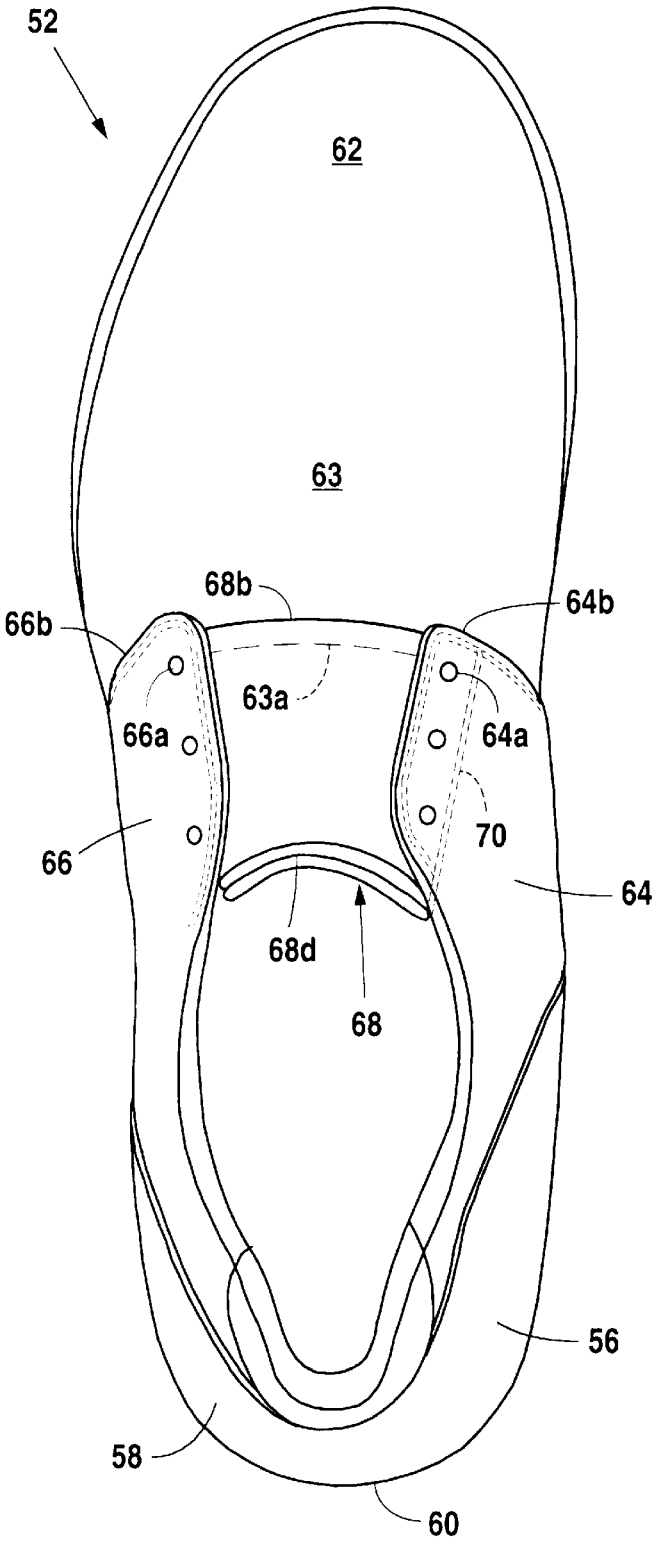
FIG. 10 is a top plan view of the shoe shown in FIGS. 6 through 8.

Referring now to FIGS. 6 through 10, a first alternate embodiment of improved footwear in accordance with the invention is illustrated and generally designated by numeral 52. The footwear 52 is characterized as a sport-type shoe having a sole 54 and opposed upper portions or quarters 56 and 58 which are connected to form a heel 60. A forward upper or toe cap 62 is connected to the sole 54, as are the quarters 56 and 58, in a conventional manner. A rearward portion 63 of toe cap 62 forms an integral forward tongue portion of the footwear 52. Forward tongue portion 63 may include a pocket similar to the pocket of forward tongue portion 32. Opposed upper portions comprising the vamp sections 64 and 66 are suitably secured to or formed as part of the quarters 56 and 58. The vamp sections 64 and 66 are also secured to the sole 54, such as by adhesive or stitching along flanges 65*a* and 65*b*, in a conventional manner. The vamp sections 64 and 66 each include suitable lace eyelets 64*a* and 66*a*, respectively, for receiving a lace 41. The forward tongue portion 63 terminates in a transverse edge 63*a*, slightly rearward of the forward edges 64*b* and 66*b* of the vamp sections 64 and 66. As illustrated in FIGS. 8 and 10, an improved split tongue is provided for the footwear 52 and includes a tongue portion 68 which is firmly and permanently secured, preferably along one longitudinal side edge 68*a* to the medial vamp section 64 by conventional stitching 70, for example. The stitching 70 may be between the eyelets 64*a* and the edge or flange 65*a* of the vamp section which is secured to the sole 54. As with the previous embodiment, the firm attachment of the tongue portion 68 to the medial vamp section 64 completely eliminates slippage of the tongue portion 68 toward the lateral side of the foot. Moreover, the permanent attachment provided by the stitching 70 eliminates the chance of detachment of the tongue portion 68 or snagging of the tongue portion or the vamp section 64 on the wearer's stockings. As mentioned previously, the attachment means may, instead of or in addition to the stitching, comprise adhesively attaching the tongue portion 68 to the vamp section 64 or a thermal or chemical bond between the vamp section 64 and the tongue portion 68 or other mechanical fastening means such as rivets. Alternatively, tongue portion 68 may be replaceably secured to vamp section 64, such as by hook and loop fastener means attached to tongue portion 68 and vamp section 64. As described above, the rearward tongue portion 68 would remain secured to the vamp section 64 until purposely replaced by the wearer.

As illustrated in FIGS. 7, 8 and 9, the tongue portion 68 is preferably characterized as a flexible cushioned member similar to the tongue portions 32 and 42 and is made up of an outer layer of material 72, having an inner layer of cushioning material 74, an inner layer of material 76 similar to the layer 72 and having a layer of cushioning material or backing 78 secured thereto, thereby providing a thin somewhat sheet-like space or pocket 80 between the material layers. The space or pocket 80 is adapted to be left vacant as shown in FIG. 7, or to receive a pad of elastomeric foam material or a saddle as previously described for the tongue portions 32 and 42. The material layers 72 and 76 are folded over at their perimeters and stitched together by a conventional stitching 77. The rear transverse edge 68*d* of tongue portion 68 may be left unstitched and provided with releasable fastener means (such as previously described in connection with tongue portion 32) for providing access to pocket 80.

Referring briefly to FIG. 9, a saddle member 81 is shown disposed in the pocket 80 and is characterized by a relatively thin, somewhat rectangular shaped member formed of a graphite-plastic composite material which has some elasticity and firmness and is operable to distribute pressure exerted by laces or other fastening devices for securing the vamp sections 64 and 66 to each other during normal wear of the shoe 52.

As with the tongue portion 42, the tongue portion 68 may be formed to facilitate comfortable engagement with the wearer's instep. The forward edge 68*b* of tongue portion 68 is positioned such that it overlies the edge 63*a*, or placed adjacent to edge 63*a* so that edges 68*b* and 63*a* meet, when the tongue portion 68 is secured to the vamp section 64. As with the footwear 12, the footwear 52 advantageously provides for a tongue portion 68 which is firmly secured to the medial vamp section 64 to prevent slippage of the tongue portion toward the lateral side of the foot when placed in use, particularly in shoes which are used for sport or athletic purposes. However, an arrangement of the tongue portion 68 wherein it is firmly secured only along an opposite longitudinal side edge 68*c* to the vamp section 66 (as opposed to only along vamp section 64) would also enjoy the benefits of the invention wherein there is little tendency to slip off to the side of the foot. The embodiment shown in FIGS. 6 through 10 is illustrative of a left shoe 52, as with the embodiment shown in FIGS. 1 through 5. The complementary right shoe is constructed in a substantially identical manner.

Figure 11:
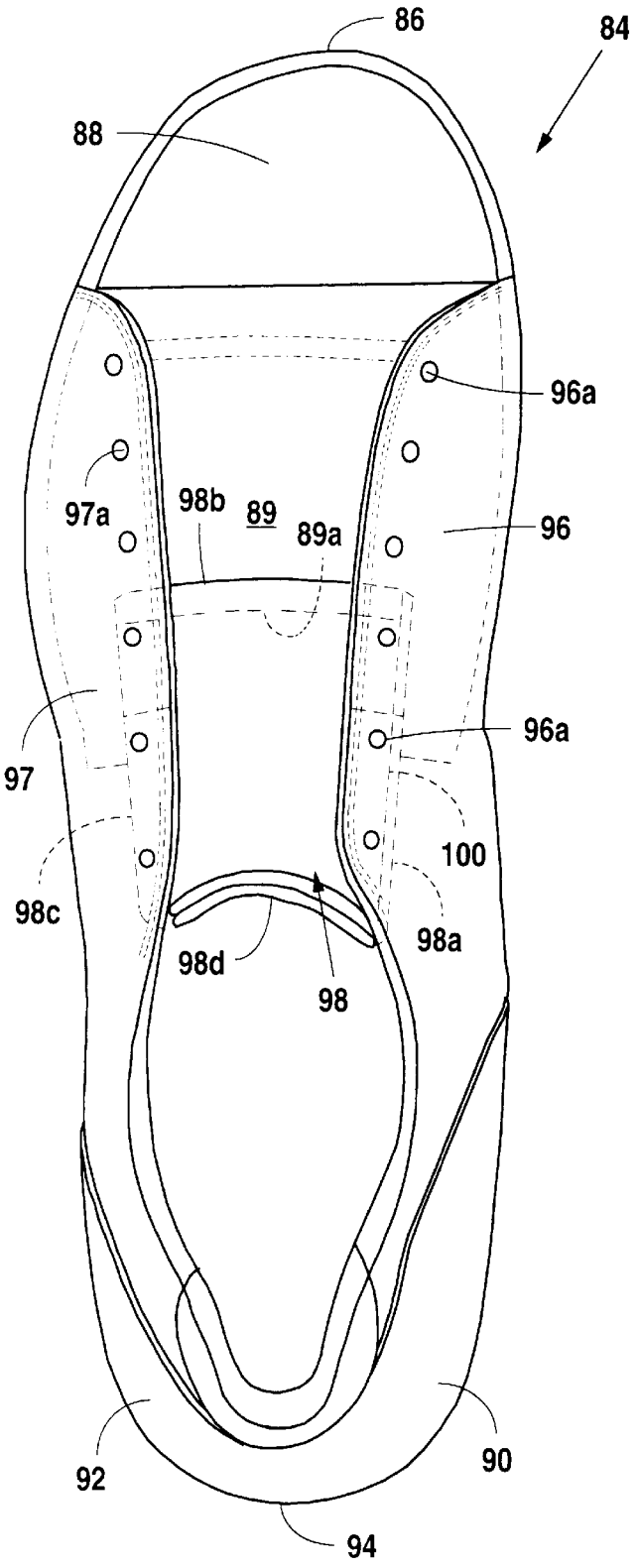
FIG. 11 is a top plan view of a full blucher shoe having a split tongue construction in accordance with the invention.

Referring now to FIG. 11, a second alternate embodiment of footwear in accordance with the invention is illustrated and generally designated by the numeral 84. The footwear 84 is shown as a left shoe and is characterized as a full blucher type shoe with a sole 86, a forward upper or toe cap 88 and rear quarters 90 and 92 which are brought together to form a heel 94. The footwear 84 also includes elongated opposed upper portions comprising medial and lateral vamp sections 96 and 97 which are constructed generally like the vamp sections for the footwear 12. However, instead of being split as in the footwear 12, vamp sections 96 and 97 are continuous one piece sections. Lacing eyelets 96*a* and 97*a* are formed along the upper edges of the vamp sections 96 and 97 for receiving conventional lacing (not shown). The footwear 84 includes a forward tongue portion 89, formed as an extension of or stitched to the toe cap or forward upper 88. The tongue portion 89 has a rearward transverse edge 89*a* and the forward tongue portion 89 may be constructed in a manner similar to the tongue portion 32 or the tongue portion 63.

The footwear 84 also has a second and rearward tongue portion 98 having a medial longitudinal edge 98*a* which firmly is attached to the medial vamp section 96 in a manner to prevent movement of the tongue portion toward the lateral side of the wearer's foot, preferably by conventional stitching 100. The tongue portion 98 has a forward transverse edge 98*b* which overlaps the rearward transverse edge 89*a* of the forward tongue portion 89 when the split tongue configuration of the footwear 84 is in its working position, such as shown in FIG. 11. Alternatively, edges 89*a* and 98*b* may be positioned adjacent to one another so as to meet rather than overlap. The rearward tongue portion 98 also has a longitudinal side edge 98*c* and a rear transverse edge 98*d*. The rearward tongue portion 98 may be constructed substantially identical to the rearward tongue portions 42 or 68, as desired. The tongue portion 98 as shown is not attached to the vamp 97 along the edge 98*c*. By preferably attaching the tongue portion 98 only to the medial vamp section 96, in a manner as described hereinabove in connection with tongue portions 68 and 42, slippage of the tongue portion 98 is substantially eliminated. As tongue portion 42 and tongue portion 68 may be firmly connected to a lateral vamp section, tongue portion 98 alternately may be firmly connected to lateral vamp section 97. Tongue portion 98 may be constructed in a manner similar to tongue portion 42 or tongue portion 68.

The footwear described herein may be constructed of conventional materials used for sport or athletic footwear, as well as for dress, outdoor or foul-weather footwear, while enjoying the advantages of the invention described above.

While the tongue for footwear of the present invention has been described in connection with preferred embodiments, it is not intended to limit the invention to the particular form set forth, but on the contrary, it is intended to cover such alternatives, modifications, and equivalents as may be included within the spirit and scope of the invention as defined by the appended claims.

What is claimed is:

1. Footwear comprising a sole, a forward upper connected to said sole and forming a toe cap, opposed vamp sections connected to said sole, whereby each of said opposed vamp sections may be drawn toward each other to secure said footwear to a foot during use, a forward tongue portion connected to said forward upper, and a rearward tongue portion firmly connected to one vamp section of said opposed vamp sections and adapted to overlie an instep of a foot disposed in said footwear without slippage toward the lateral or medial side of a foot during use, wherein said tongue portions are split such that said rearward tongue portion is independently separate from said forward tongue portion, and wherein said opposed vamp sections comprise a pair of opposed forward vamp sections and a pair of opposed rearward vamp sections, said forward tongue portion is adapted to be disposed under said opposed forward vamp sections when said opposed forward vamp sections are secured to each other, and said rearward tongue portion is adapted to be disposed under said opposed rearward vamp sections when said opposed rearward vamp sections are secured to each other.

2. The footwear set forth in claim 1 wherein:

said rearward tongue portion is firmly connected permanently to one rearward vamp section of said opposed rearward vamp sections.

3. The footwear set forth in claim 2 wherein:

said rearward tongue portion is firmly connected permanently to a medial rearward vamp section of said opposed rearward vamp sections.

4. The footwear set forth in claim 1 wherein:

said rearward tongue portion is firmly connected replaceably to one rearward vamp section of said opposed rearward vamp sections.

5. The footwear set forth in claim 4 wherein:

said rearward tongue portion is firmly connected replaceably to a medial rearward vamp section of said opposed rearward vamp sections.

6. The footwear set forth in claim 1 wherein:

at least one of said tongue portions includes a pocket for receiving one of a cushioning member and a saddle member in said pocket.

7. The footwear set forth in claim 6 wherein:

said pocket is at least partially occupied by said one of said cushioning member and said saddle member.

8. The footwear set forth in claim 6 wherein:

said pocket includes an opening formed in one edge of said one tongue portion for inserting and removing said one of said cushioning member and said saddle member.

9. The footwear set forth in claim 6 wherein:

said saddle member comprises a member operable to distribute pressure exerted on a wearer's foot.

10. The footwear set forth in claim 6 wherein:

said one tongue portion includes closure means for releasably closing said pocket to retain said one of said cushioning member and said saddle member in said pocket.

* * * * *